United States Patent [19]

Buzzella

[11] 4,375,737

[45] Mar. 8, 1983

[54] SLIDING SASH WINDOW ASSEMBLY

[76] Inventor: Joseph R. Buzzella, 630 W. 84th St., Hialeah, Fla. 33014

[21] Appl. No.: 137,240

[22] Filed: Apr. 4, 1980

[51] Int. Cl.[3] ..... E06B 3/26; E06B 3/54

[52] U.S. Cl. ..... 49/428; 49/454; 160/90

[58] Field of Search ..... 160/90, 91, 89, 87; 49/431, 433, 419, 453, 454, 428; 16/216, 314, 320

[56] References Cited

U.S. PATENT DOCUMENTS

| | | | |
|---|---|---|---|
| 1,157,125 | 10/1915 | Schroyer | 49/431 |
| 3,080,620 | 3/1963 | Mendelsohn | 49/454 X |
| 3,174,194 | 3/1965 | Ward | 49/431 |
| 3,596,404 | 8/1971 | Moose | 49/419 |

FOREIGN PATENT DOCUMENTS

| | | | |
|---|---|---|---|
| 715784 | 9/1954 | United Kingdom | 49/419 |

*Primary Examiner*—Peter M. Caun
*Assistant Examiner*—Cherney S. Lieberman
*Attorney, Agent, or Firm*—Ernest H. Schmidt

[57] ABSTRACT

A sliding window sash assembly glazed with vinyl film and adapted for easy attachment to framework openings in screened enclosures and the like for use as a wind break under adverse weather conditions is described. Both the window framework and the sash frameworks are fabricated of thin wall-section extruded aluminum members, and to prevent sticking and jamming of the sashes in the frame, improved slide members are removably fitted along the sash side rails and slidingly fitted in vertically-extending, T-shaped grooves formed along the insides of the window frame. The slides are fabricated of a resilient plastic material, hollow along their lengths for the reception of compression springs operative to frictionally press longitudinal side portions of the slide members against inner wall portions of the T-shaped grooves along which they slide.

7 Claims, 12 Drawing Figures

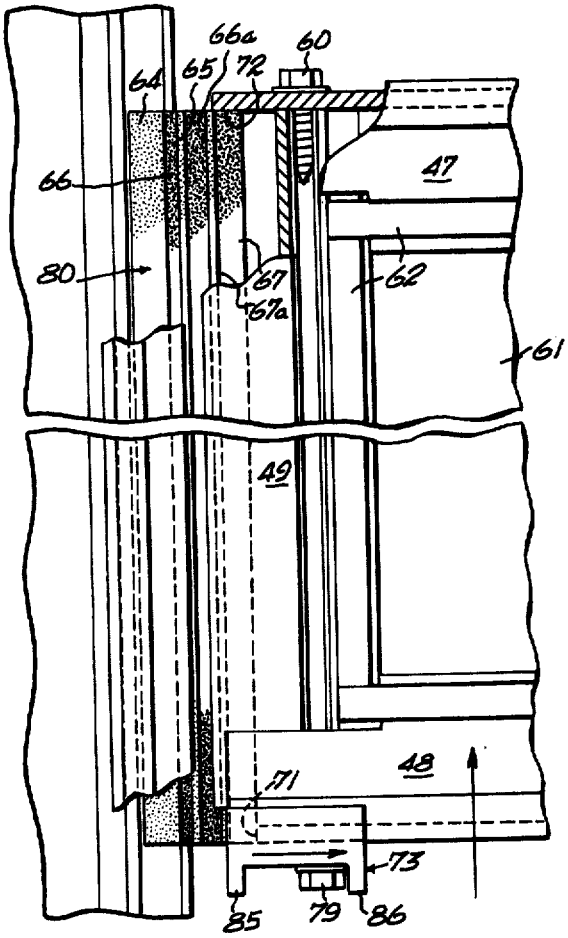
Fig. 8
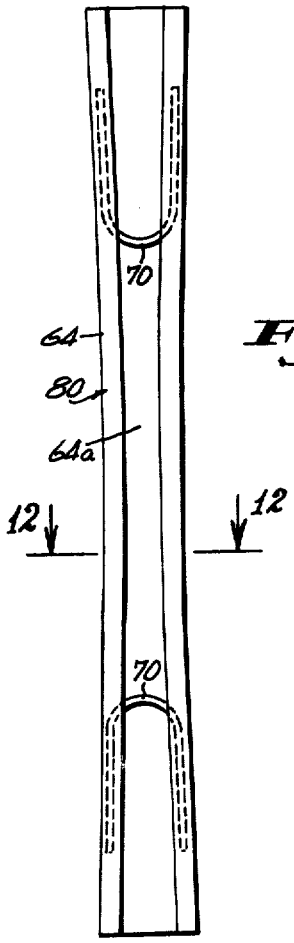
Fig. 9
Fig. 11
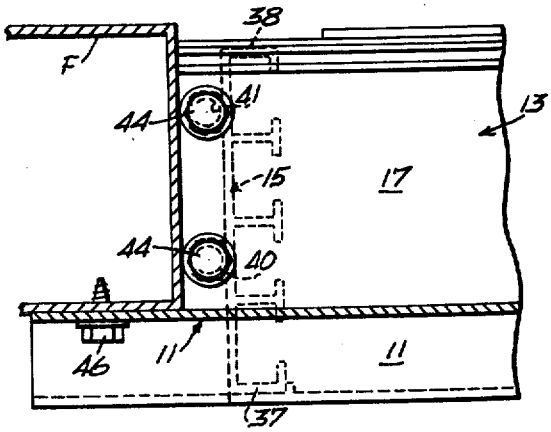
Fig. 10
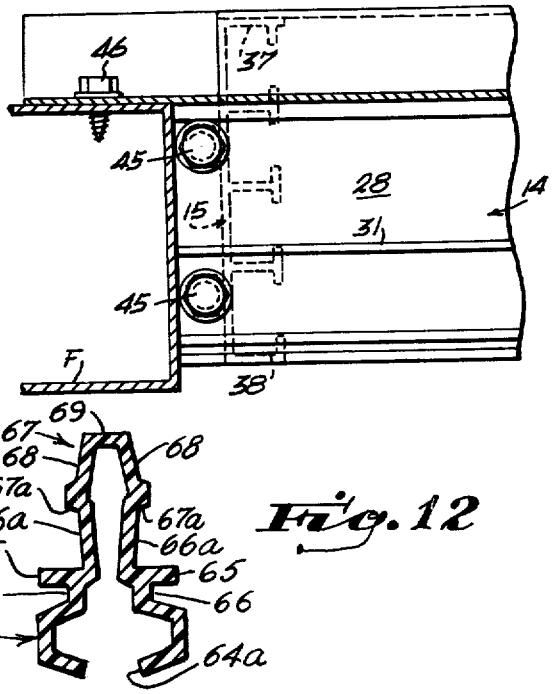
Fig. 12

SLIDING SASH WINDOW ASSEMBLY

BACKGROUND OF THE INVENTION

This invention relates to windows and is directed particularly to improvements in sliding sash window frames for use in association with pre-existing supporting framework openings in screen enclosures and the like.

Various types of inexpensive and lightweight sliding sash window assemblies have heretofore been devised for attachment to pre-existing screen openings and the like to provide a measure of weather protection, particularly during winter months. U.S. Pat. No. 3,596,404 to Moose describes, by way of example, a typical sliding sash window assembly of the type heretofore known, which are deficient particularly in the non-metallic frictional slide mechanism utilized between the outer window frame and the window sashes. Since the friction slide mechanism not only needs to provide for smooth up and down sliding of the window sashes in the frame, but also serves to permit ready removal of the sashes from the frame, design problems in meeting both of these requirements have been encountered. One solution has been to provide compression spring means at one side of a window sash and acting against a friction slide member at that side to enable sideward shifting of the sash sufficiently to release the friction slide member at the other side and thereby permit its removal. Another solution to the problem has been to secure the slide members in grooves along the outer edges of the sash, held in place by transversely-extending detent means or the like which, when released, permits sliding withdrawal of the sash from the slide members. Such solutions have proven to be unsatisfactory in combining smooth sliding operation of the sashes without binding and without metal-to-metal sliding contact, while at the same time providing easy and expeditious removal of the sashes for cleaning or the like.

It is, accordingly, the principal object of this invention to provide a multiple sliding sash window assembly of the above nature wherein elongated vinyl slides are used as intermediate members between the opposed side rail members of the associated sashes, the slides being hollow along their length and open along the outsides for the reception of compression springs operative to frictionally press longitudinal side portions of the slide members against inner side wall portions of longitudinally-extending T-shaped grooves formed at the insides of the window frame and within which the slide members ride.

Yet another object of the invention is to provide a multiple sliding sash window assembly including easily operated attachment mechanism for removing and replacing the window sashes in their frame.

Other objects features and advantages of the invention will be apparent from the following description when read with reference to the accompanying drawings.

BRIEF DESCRIPTION OF THE DRAWINGS

In the drawings, wherein like reference numerals denote the corresponding parts throughout the several views:

FIG. 8 is a partial outside elevational view illustrating how release of the slide-lock members permits the removal, one at a time, of the window sashes from the window frame;

FIG. 9 is an elevational view of one of the window sash vertical slide members together with its interior spreader springs looking into the longitudinal interior opening thereof;

FIG. 10 is a horizontal cross-sectional view taken along the line 10—10 of FIG. 1 in the direction of the arrow;

FIG. 11 is a horizontal cross-sectional view taken along the line 11—11 of FIG. 1 in the direction of the arrows; and FIG. 12 is a transverse view taken along the line 12—12 of FIG. 9 in the direction of the arrows, on an enlarged scale.

Referring now in detail to the drawings, the reference numeral 10 in FIGS. 1 and 2 designates, generally, a sliding sash wind breaker window assembly embodying the invention, the same being comprised of a window frame 11 and window sashes **12*a*, 12*b*, 12*c*, 12*d* vertically slidably arranged in said window frame, as is hereinafter described. FIG. 2 illustrates the window assembly with its sashes all in their lower-most positions to provide maximum window opening. As hereinafter more particularly described, the window frame 11 is provided with an outwardly-extending peripheral flange, and is of such rectangular size as to fit into a screen framework opening F, which will ordinarily be one of a plurality of screen framework openings in a screened patio or the like. The sashes 12*a*, 12*b*, 12*c*, 12*d*** will preferably be glazed with sheet vinyl film, approximately 10 mills in thickness, instead of the usual glass, for economy, durability and lightness in weight. Additionally, the vinyl glazing can be either clear, opaque or tinted, as desired.

Figure 3:
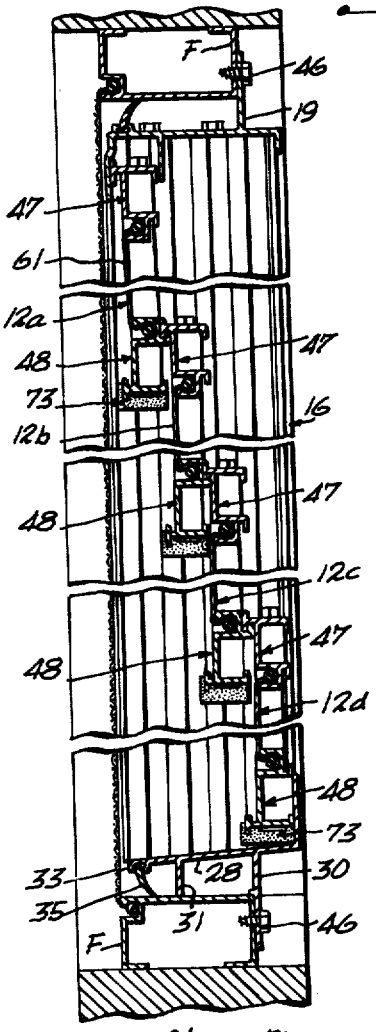
FIG. 3 is a vertical cross-sectional view taken along the line 3—3 of FIG. 1 in the direction of the arrows and illustrating constructional details of the wind breaker window assembly.
Figure 4:
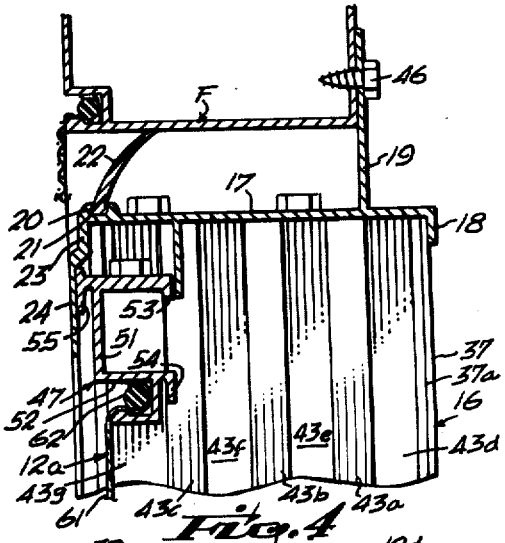
FIG. 4 is a fragmentary view, on an enlarged scale, of the upper end portion of the cross-section illustrated in FIG. 3.

The window frame 11, which is preferably fabricated of extruded aluminum parts, comprises a window frame header member 13, a window frame sill member 14 and side frame or stile members 15 and 16, respectively. As is best illustrated in FIGS. 2, 3, 4 and 11, the window frame header member 13 is integrally formed with an elongated, horizontal wall portion 17, a short downwardly-extending front skirt portion 18, and an upwardly extending vertical flange portion 19 spaced somewhat rearwardly of said front skirt portion. The header member 13 is also formed, along the rear end thereof, with a recessed boss 20 defining an inverted T-groove 21 fitted with an outwardly-extending vinyl seal member 22 adapted to abut against the inside of the screen framework F to which the window is assembled, as illustrated in FIGS. 3 and 4. The window frame header member 13 is further formed along its length with a downwardly-extending rear end portion 23 terminating in an outwardly-offset skirt portion 24.

Figure 5:
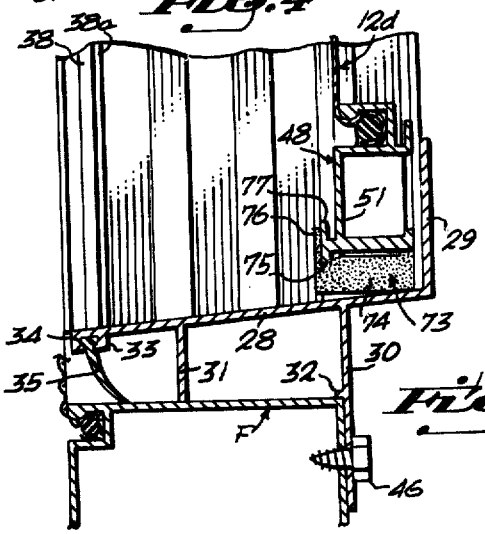
FIG. 5 is a fragmentary view, on an enlarged scale, of the lower end portion of the cross-section illustrated in FIG. 3.

As best illustrated in FIGS. 1, 3, 5 and 11, the window frame sill member 14 is integrally formed along its length with an elongated wall portion 28 having an upwardly-extending front skirt portion 29 and a downwardly-extending flange portion 30 spaced somewhat rearwardly of said skirt portion. As best illustrated in FIG. 5, the skirt portion 29 and the flange portion 30 are parallel with one another, but join with the wall portion 28 at angles slightly removed from the perpendicular to effect a downward slope from the inside to the outside of the wall portion 28. The elongated wall portion 28 of the window frame sill member 14 is also integrally formed along its length with a downwardly-extending spacer web portion 31, and the flange portion 30 of said wall portion is formed along its length with a rearwardly-extending abutment lip portion 32 which, together with the lower end of the spacer web portion 31, provides abutment means for locating the sill against the bottom rail of a screen framework F. The sill member wall portion 28 is further formed along its outer end with a downwardly-extending boss 33 provided along its length with a T-groove recess 34 for the reception of a vinyl seal 35. The window frame side frame members or stile members 15 and 16, as is best illustrated in FIGS. 3 through 6, 10 and 11 are identical in cross-sectional shape and comprise an elongated side wall portion 36 integrally formed along its length with front and back, inwardly-extending skirt portions 37, 38, respectively, and an outwardly-extending flange portion 39 parallel with said front skirt portion at a position somewhat to the rear thereof. The outsides of the side wall portions 36 of the side frame members 15 and 16 are each integrally formed along their lengths, at that portion thereof between the outwardly-extending flange portion 39 and the back or rear skirt portion 38, with mutually-spaced bosses 40, 41 formed with co-extensive arcuate recesses 42 which serve as attachment means for assembly of the window frame 11 with the use of self-tapping screws, as is hereinbelow more particularly described. The side frame members 15, 16 are also formed, along the insides of their elongated horizontal wall portion 36, with mutually equidistantly-spaced, inwardly-extending guide rails 43*a*, 43*b*, 43*c*, which are T-shaped in cross-section. The front and back, inwardly-extending skirt portions 37, 38 are integrally formed with opposed, inwardly-projecting web portions 37*a*, 38*a* respectively. The T-shaped guide rails 43*a*, 43*b* and 43*c*, together with inwardly-extending skirt portions 37, 38 and their respective web portions 37*a*, 38*a*, define vertically aligned, T-shaped grooves 43*d*, 43*e*, 43*f* and 43*g* for the vertical sliding reception of window sash slide members 80, as is hereinafter more particularly described.

As best illustrated in FIGS. 10 and 11, the window frame 11 is secured in assembled relation by the means of self-tapping screws 44 extending through openings in the horizontal wall portion 17 of the window frame header member 13 into the upper end openings of the bosses 40, 41 of the side frame members 15, 16, and self-tapping screws 45 extending through openings in the wall portion 28 of the frame sill member 14 into the lower end openings of said bosses. The window frame 11 will be of such size as to fit within the screen opening of a screen framework F, with the flange portions 19, 30 of the frame header and frame sill member, and flange portions 39 of the side frame members 15 and 16 overlying marginal inner wall portions of said screen framework and being attached thereto as by self-tapping screws 46. As illustrated in FIG. 4, when so installed the vinyl seal members 22 and 35 will seal against the insides of the top and bottom rails of the screen framework opening to prevent leakage of air.

The window sashes 12*a*, 12*b*, 12*c*, 12*d* are identical in construction, being formed of extruded aluminum members comprising sash frame upper and lower members 47, 48, respectively, held in spaced, parallel relation by means of identical sash frame side members 49 and 50. The sash frame upper member is formed along its length (see FIG. 4) with an inwardly-facing, rectangular open channel 51 below which is a coextensive, relatively small rearwardly-extending open rectangular channel 52. The front open ends of the channel 51 are integrally formed with upper and lower downwardly-extending lips 53, 54, respectively. The upper wall of the rectangular open channel 51 is integrally formed along its length with a rearwardly-extending projection 55 which is T-shaped in cross-section. The sash frame lower member 48 is identical in construction to that of the sash frame upper member 47, but is turned end for end so that the larger rectangular open channel 51 is nearest to the outside of the sash, (see FIG. 5).

The sash frame side members 49 and 50 are also identical in construction and are formed with an outwardly-extending open rectangular channel 56, the outer marginal edge portions of which are provided with inwardly-extending opposed lips 57. Each sash frame side member is also formed along its length, adjacent the inner end of the rectangular channel 56, with a rearwardly-open channel 58 of substantially arcuate cross-sectional shape, end portions of which, as is hereinbelow described, serve as attachment means for self-tapping screws in the assembly of the sash. Each sash frame side member 49, 50 is also formed along its length, at the inside thereof, with a coextensive substantially-rectangular channel 59, open to the rear or outside of the window. As is best illustrated in FIG. 8, channel side wall portions of the sash frame upper and lower members 47 and 48 are cut away at the ends thereof to receive in interfitting engagement the ends of the sash frame side members 49, 50, and said sash frame members are assembled in relatively fixed disposition by means of self-tapping screws 60 extending through openings in said upper and lower sash frame members into attachment means afforded by end portions of the arcuate channels 58 in said sash frame side members. The assembled sashes 12*a*, 12*b*, 12*c*, 12*d* are glazed with vinyl film sheeting 61 held in place by a vinyl spline 62 press-fitted within their rectangular channels 52 in the sash frame upper and lower members 47 and 48, and the channels 59 in the sash frame side members 49, 50 (see FIGS. 3, 4, 5 and 6).

Figure 6:
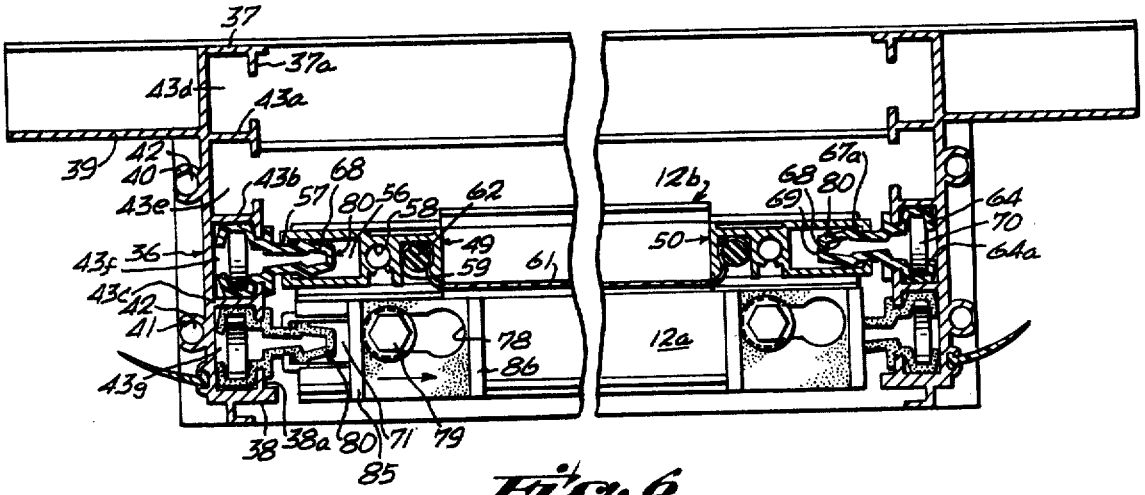
FIG. 6 is a horizontal cross-sectional view taken along the line 6—6 of FIG. 1 in the direction of the arrows, illustrating constructional details of the wind breaker window assembly slide mechanism.
Figure 7:
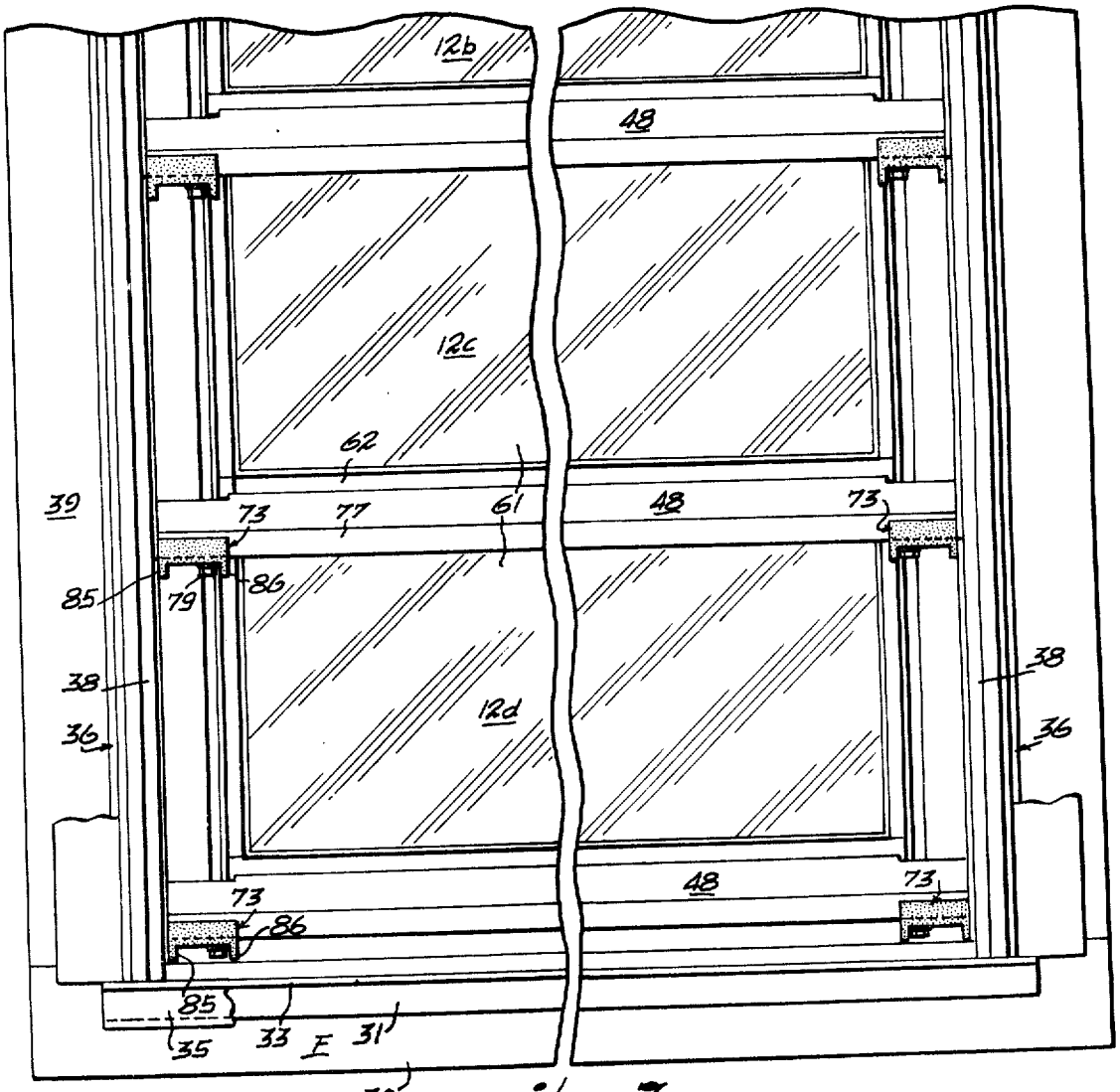
FIG. 7 is a fragmentary outside elevational view of the window assembly illustrating details of the slide-lock members for removably securing the individual window sashes in place in the window frame.

Means are provided for slidably mounting the window sashes 12*a*, 12*b*, 12*c* and 12*d* in the window frame 11. To this end, each sash is provided with a pair of vinyl slide members 80, one at each side, (see FIGS. 6, 8 and 9). Each vinyl slide member 80, which is uniform in cross-sectional shape, is formed with a substantially rectangular portion 64 along its length, (see FIG. 12) of such size as to be received for sliding movement along and within one of the T-shaped grooves 43*d*, 43*e*, 43*f* and 43*g*. The substantially rectangular portion 64 extends into an intermediate portion 65 of somewhat reduced lateral width, and being formed along each side with rectangular recesses 66 for the sliding reception of opposed, inwardly-projecting portions of guide rails 43*a*, 43*b*, 43*c* and web portions 37*a*, 38*a*. The intermediate portion 65 extends into a reduced-width neck portion 66*a* terminating in a head portion 67 defining therewith opposed longitudinal shoulders 67*a*. The head portion 67 is formed with convergent side wall portions 68 terminating in a transverse end wall 69. The substantially rectangular portion 64 of the vinyl slide member 80 is formed along the outside with an opening slot 64*a* communicating with a hollow interior, thereby rendering the slide member resilient to compression along the outsides of said substantially rectangular portion 64. As illustrated in FIGS. 6 and 9, U-shaped compression springs 70 are fitted within the substantially rectangular portion 64 at the ends of the slide members 80 to compress the side walls thereof in close-fitting frictional engagement against opposed sidewall portions of their respective T-shaped grooves 43*d*, 43*e*, 43*f* and 43*g*. The end portions of the slide 80 illustrated separately in FIG. 9 but with the U-shaped compression springs 70 installed, illustrate how the springs constrain outer sidewall portions of the substantially rectangular portion 64 of the vinyl slide member for close-fitting frictional engagement as described above.

As illustrated in FIG. 6, the head portions 67 of slide members 80 are slidably receivable, end-wise, in rectangular channels 56 in sash frame slide members 49 or 50. As illustrated in FIG. 8, the sash lower member 48 is cut away or recessed, as indicated at 71, to permit end-wise passage over slides 80 upon assembly or disassembly, as hereinafter more particularly described. With further reference to FIG. 8 it will be seen that, when assembled, the upper end of a slide member 80 will abut against an upper end portion of sash frame upper member 47 as indicated at 72, and is of such length as to register, at its lower end, with the bottom of sash frame bottom member 48.

Means are provided for removably securing the vinyl slide members 80 in their respective sash grooves 43*d*, 43*e*, 43*f* and 43*g*. To this end, as illustrated in FIGS. 3, 5, 6, 7 and 8 a vinyl slide lock members 73 is provided at each end of sash frame lower member 48. The slide lock members 73 are formed with a rectangular base portion 74 (see FIG. 5) having a shallow recess 75 along one side extending into an upwardly projecting side wall portion 76 received within and behind which is an outwardly-projecting portion 77 integrally formed along the bottom of sash frame lower member 48. The rectangular base portion 74 of slide lock member 73 is formed along its length with a dumb-bell shaped opening 78 (see FIG. 6) for the reception of a flange-headed self-tapping screw 79 serving to support said slide lock member in place while, at the same time, securing the said lower frame member 48 to sash frame side members 49 and 50. The ends of the slide lock member body portion 74 are integrally formed with outwardly-extending, finger-grip portions 85, 86 by means of which the slide lock members can be pushed between unlocking positions, as illustrated in the left hand portion of FIG. 6, and locking position, as illustrated by the right hand portion of FIG. 6. In this connection, it is to be noted that the reduced width neck portion of the dumb-bell shaped opening 78 will be approximately the same size as the diameter of the shank portion of the attachment screw passing therethrough, so as to provide for snap action upon movement of the slide lock members between locking and unlocking positions.

Figure 1:
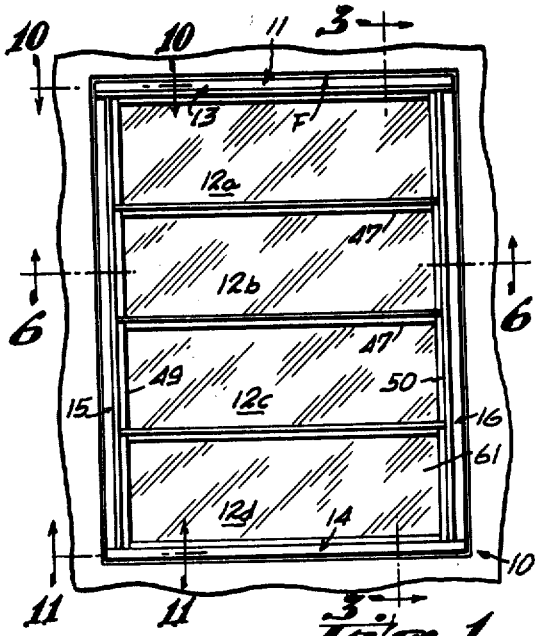
FIG. 1 is an inside or front elevational view of a sliding sash wind breaker window assembly embodying the invention shown applied to the screening framework openings.
Figure 2:
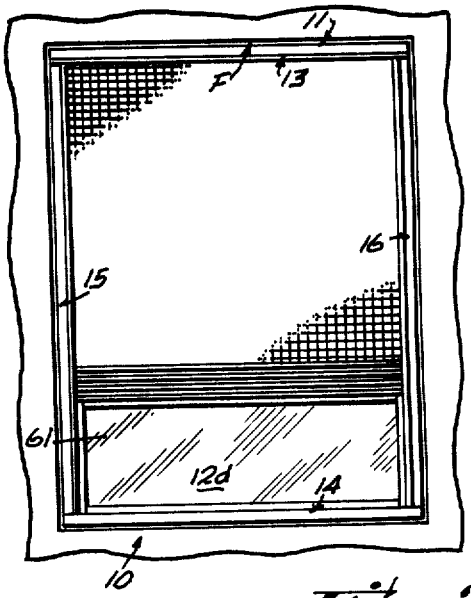
FIG. 2 is a view similar to FIG. 1 but showing the window sashes all in their downward-most positions.

In use and operation, the window sashes are inserted and removed sequentially, whenever necessary, with the innermost sash 12*a* being inserted first from the inside of the window, as seen in FIGS. 1 and 2. Upon insertion, the respective slide lock member pairs 73 will first have been moved to their withdrawn positions to permit the associated slide members 80, which will have been placed in their respective T-shaped grooves 43*d*, 43*e*, 43*f* or 43*g* to be slideably received, end-wise, in the pertaining rectangular channels 56 of the sash frame slide members 49 and 50, (see FIG. 6), after which, when fully received therein, the slide lock members 73 will be moved to their outward-most or locked position to prevent relative movement with respect to the slide members as the sashes are moved up and down within their frame. Removal of the sashes is accomplished simply by reversal of the insertion sequence procedure.

While there is illustrated and described herein only one form in which the invention can conveniently be embodied in practice, it is to be understood that this form is presented by way of example only and not in a limiting sense. For example, although vinyl film has been described and illustrated herein as the glazing material in the sashes, ordinary glass could alternatively be used.

The invention, in brief, comprises all the embodiments and modifications coming within the scope and spirit of the following claims.

What is claimed as new and for which it is desired to secure Letters Patent is:

1. A sliding sash window assembly comprising, in combination, a rectangular window frame having respective upper and lower frame header and sill members interjoined at their ends with opposed, parallel side frame members, a plurality of rectangular window sashes, means slidingly interconnecting said sashes in said window frame for relative sliding up and down movement therein, said interconnecting means comprising frictional contact means between said sashes and said frame for frictionally retaining said sashes in adjusted vertical positions in said frame, said frictional contact means comprising T-shaped grooves formed along the insides of said side frame members, a plurality of synthetic plastic slide members, said slide members being formed along their lengths with a substantially rectangular portion of uniform cross-sectional shape receivable within said T-shaped grooves for up and down sliding movement therealong, opposed outer side portions of said slide members being formed therealong with end-to-end recesses, said T-shaped grooves being defined by opposed inwardly-projecting portions receivable in said recesses, said slide members being hollow from end-to-end along their length, and compression spring means within said slide members for yieldingly constraining opposed outer surface portions of said substantially rectangular portion of said slide members against opposed inner wall portions of said frame members defining said T-shaped grooves, said substantially rectangular portions of said slide members being slotted along their outsides to open into the hollow interior thereof, said spring means comprising a U-shaped compression spring fitted within each end of said slide members so as to resiliently urge said opposed outer surface portions of said slide members in relatively outward directions.

2. A sliding sash window as defined in claim 1 wherein said slide members are integrally formed with head portions of uniform cross-sectional shape along their lengths, and wherein said window frame and said window sashes are fabricated of extruded metal members, said head portions being slidably received within and along channels provided along the outsides of the vertical side members of said rectangular sash frames.

3. A sliding sash window as defined in claim 2 wherein said sash frame channels are open along the outside, said openings being defined by opposed, relatively inwardly-extending lip portions providing end-to-end interior shoulders, said slide member head portions being seatable along their length against said shoulders to constrain said slide members against lateral withdrawal through said sash recesses.

4. A sliding sash window as defined in claim 3 including means preventing metal-to-metal contact between the sides of said sash members and the insides of said window frame side members.

5. A sliding sash window as defined in claim 4 wherein said metal-to-metal contact prevention means comprises outer wall portions of said slide member end-to-end recesses.

6. A sliding sash window as defined in claim 5 wherein the lengths of said slide members are substantially equal to lengths of said sash frame channels, means blocking the upper ends of sash frame channels, and means for selectively blocking the lower ends of said sash frame channels for securing slide members received therein against relative sliding movement.

7. A sliding sash window as defined in claim 6 wherein said sash frame channel lower end blocking means comprises slide members slidably secured against the underside of the bottom member of said rectangular sash frame and moveable between blocking and unblocking position, selectively, with respect to the lower end opening of said sash frame vertical slide member channel.

* * * * *